US006434833B1

(12) United States Patent
Yeh

(10) Patent No.: US 6,434,833 B1
(45) Date of Patent: Aug. 20, 2002

(54) HAIRDRESSING SCISSOR ASSEMBLY

(76) Inventor: Wen-Ya Yeh, Suite 2, 15th Floor, No. 18, Chuney-Hsueh Road, Tainan (TW)

( * ) Notice: Subject to any disclaimer, the term of this patent is extended or adjusted under 35 U.S.C. 154(b) by 0 days.

(21) Appl. No.: 09/934,117

(22) Filed: Aug. 20, 2001

(51) Int. Cl.[7] ..... B26B 13/00; B26B 13/24
(52) U.S. Cl. ..... 30/226; 30/254
(58) Field of Search ..... 30/226, 227, 254, 30/260, 196, 197

(56) References Cited

U.S. PATENT DOCUMENTS

2002/0020067 A1 * 2/2002 Silver ..... 30/226

* cited by examiner

*Primary Examiner*—Douglas D. Watts
(74) *Attorney, Agent, or Firm*—Alan Kamrath Rider, Bennett, Egan & Arundel, LLP

(57) ABSTRACT

A pair of hairdressing scissors comprises two cutting members pivotally connected together. Each cutting member comprises a handle at a first end thereof and a blade at a second end thereof. At least one first positioning hole is defined in a side of a first one of the handles. At least one second positioning hole is defined in a side of a second one of the handles. At least one first engaging member is secured to the other side of the first handle. At least one second engaging member is secured to the other side of the second handle. An end of each of the first and the second engaging members of one pair of hairdressing scissors is releasably force fitted into an associated one of the first and second positioning holes of another pair of hairdressing scissors.

20 Claims, 12 Drawing Sheets

HAIRDRESSING SCISSOR ASSEMBLY

BACKGROUND OF THE INVENTION

1. Field of the Invention

The present invention relates to a hairdressing scissor assembly comprising plural pairs of scissors that are detachably engaged together for hairdressing purpose.

2. Description of the Related Art

A hairstylist cuts a customer's hair with several techniques, including trimming, thinning, layering, etc. Sometimes the hairstylist has to hold plural pairs of scissors in the same hand for proceeding with the thinning or layering of the hair to obtain the desired special hairstyle.

During operation of the plural pairs of scissors in the same hand, the user must keep the plural pairs of scissors be spaced at regular intervals and operate them with the same operating condition. The plural pairs of scissors must open and close synchronously to obtain a tidy, beautiful hairstyle. However, the plural pairs of scissors are simply held by the index finger and the thumb of the user such that the plural pairs of scissors cannot be operated synchronously due to touchy control of the plural pairs of scissors by the fingers. Thus, the plural pairs of scissors often become skew to one another and the spacing therebetween may be different from one another. The haircutting result is adversely affected, and this problem is aggravated if the user is inexperienced. The user often feels pain when operating the plural pairs of scissors in addition to numerous limitations to and difficulties in operation.

U.S. Pat. No. 6,192,590 to Applicant issued on Feb. 27, 2001 and Applicant's U.S. patent application Ser. No. 09/617,713 disclose hairdressing scissor assemblies to solve the above-mentioned problems. However, formation of the L-shaped engaging member and the L-shaped slot of the connecting block for connecting the plural pairs of scissors is troublesome and costly.

SUMMARY OF THE INVENTION

A hairdressing scissor assembly in accordance with the present invention comprises plural pairs of hairdressing scissors. Each pair of hairdressing scissors in accordance with comprises:

a first cutting member and a second cutting member pivotally connected together, the first cutting member comprising a first handle at a first end thereof and a first blade at a second end thereof, the second cutting member comprising a second handle at a first end thereof and a second blade at a second end thereof, the first handle comprising a first side and a second side, at least one first positioning hole being defined in the first side of the first handle, the second handle comprising a first side and a second side, at least one second positioning hole being defined in the first side of the second handle;

at least one first engaging member secured to the second side of the first handle, said at least one first engaging member comprising an end; and at least one second engaging member secured to the second side of the second handle, said at least one second engaging member comprising an end;

the end of said at least one first engaging member of one said pair of hairdressing scissors being releasably force fitted into said at least one first positioning hole of another said pair of hairdressing scissors;

the end of said at least one second engaging member of one said pair of hairdressing scissors being releasably force fitted into said at least one second positioning hole of another said pair of hairdressing scissors.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
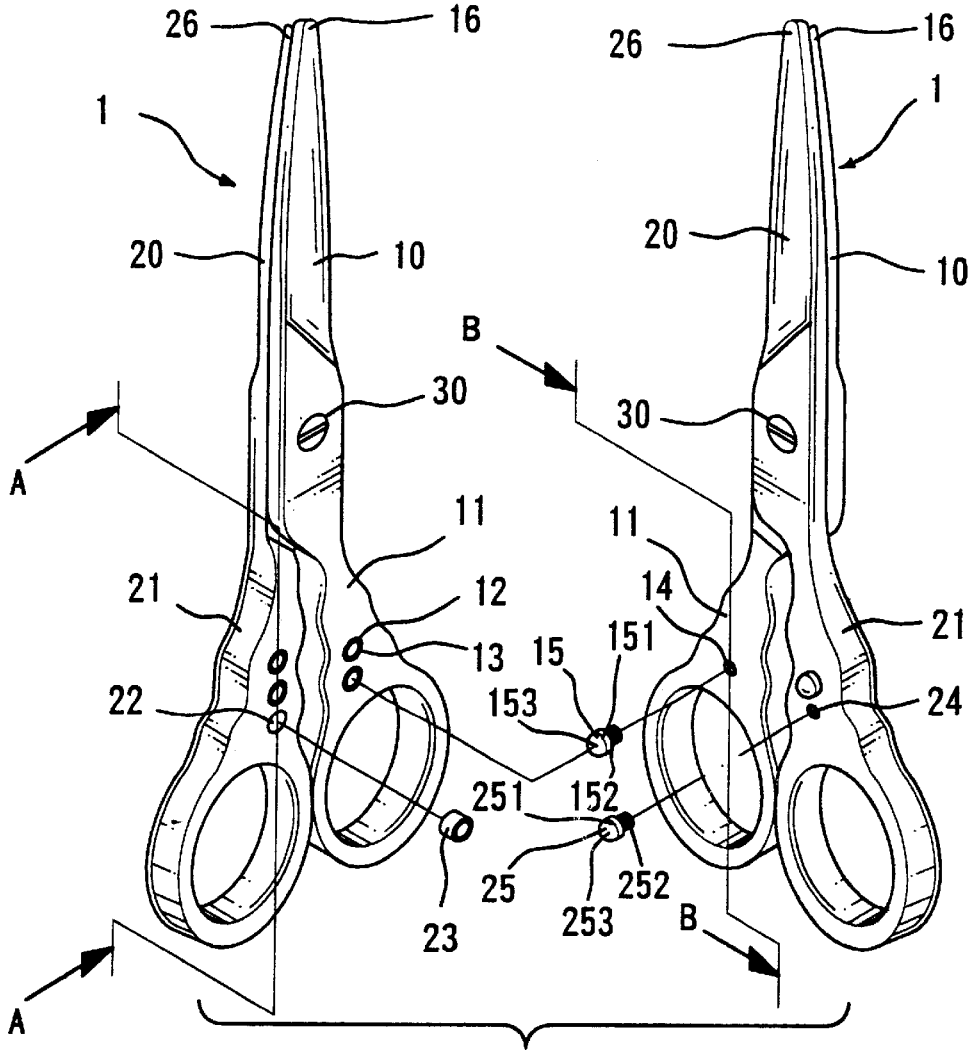
FIG. 1 is an exploded perspective view of a first embodiment of a hairdressing scissor assembly in accordance with the present invention.

Referring to FIG. 1, a first embodiment of a hairdressing scissor embodiment in accordance with the present invention generally comprises plural pairs of scissors 1 each having first and second cutting members that are pivoted together by a pivot 30. The first cutting member comprises a first handle 11 on an end thereof and a first blade 10 on the other end thereof The second cutting member comprises a second handle 21 on an end thereof and a second blade 20 on the other end thereof. Each blade 10, 20 has a tip 16, 26. The first and second cutting members are pivoted together at intermediate portions thereof. Of course, each handle 11, 21 has an opening (not labeled) for the thumb or index finger of the user.

The first handle 11 comprises two positioning holes 12 defined in a first side thereof and the second handle 21 comprises three positioning holes 22 defined in a first side thereof. The first handle 11 further comprises a positioning hole 14 defined in a second side thereof and the second handle 21 comprises two positioning holes 22 defined in a second side thereof The positioning holes 14 and 24 may be screw holes.

At least one sleeve 13, 23 is mounted in the positioning hole 12. 22. In this embodiment, a sleeve 13, 23, preferably made of rubber or plastic material, is mounted in each positioning hole 12, 22. Plural engaging members 15 and 25 are provided to connect two pairs of hairdressing scissors 1. Each engaging member 15, 25 comprises a first end 151, 251 releasably secured in an associated one of the positioning holes 12. 22 and a second end 152, 252 secured in an associated one of the positioning holes 14. 24. In this embodiment, the second end 152, 252 of each engaging member 15, 25 is threaded for threading engagement with the associated screw hole 14, 24. Nevertheless, the second end 152, 252 of each engaging member 15, 25 can be secured to the second side of the associated handle 11, 21 by force fitting, welding, bonding, or any other suitable means. The first end 151, 251 of each engaging member 15, 25 has a dome 153, 253 for guiding the engaging member 15, 25 into an associated one of the sleeves 13, 23 when the first end 151, 251 is releasably force fitted into the associated one of the sleeves 13,23.

Figure 2:
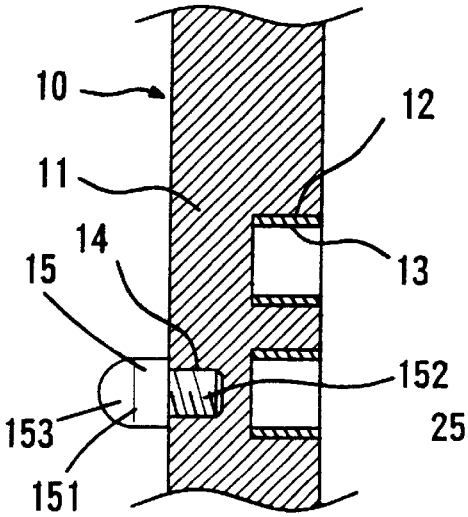
FIG. 2 is a partial sectional view taken along plane A—A in FIG. 1, illustrating a portion of a handle of a hairdressing scissor in FIG. 1.
Figure 3:
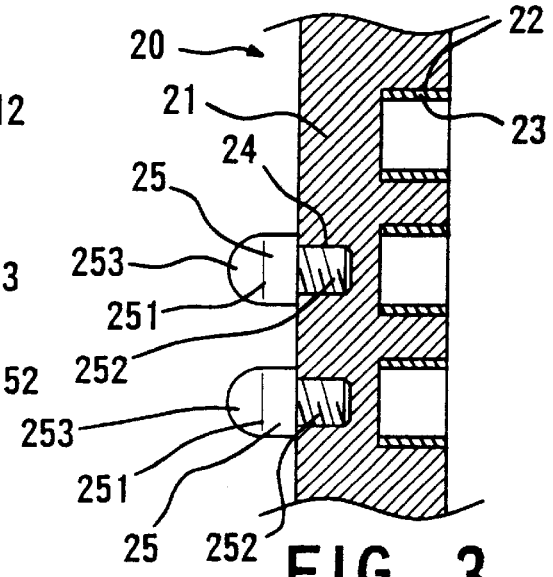
FIG. 3 is a partial sectional view, taken along plane B—B in FIG. 1, illustrating a portion of the other handle of a hairdressing scissor in FIG. 1.
Figure 4:
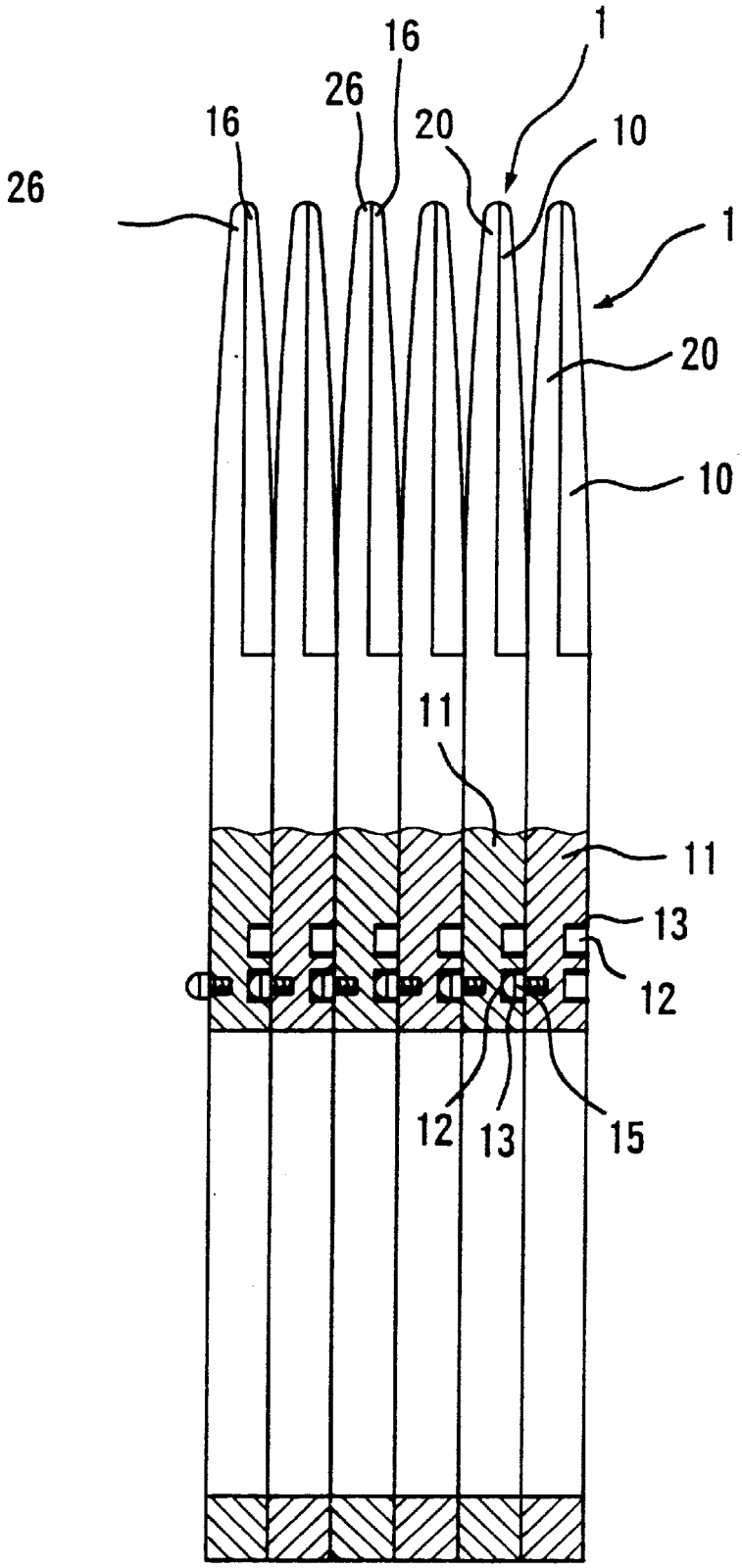
FIG. 4 is a side view, partly sectioned along plane A—A in FIG. 1, of the first embodiment of the hairdressing scissor assembly in accordance with the present invention.
Figure 5:
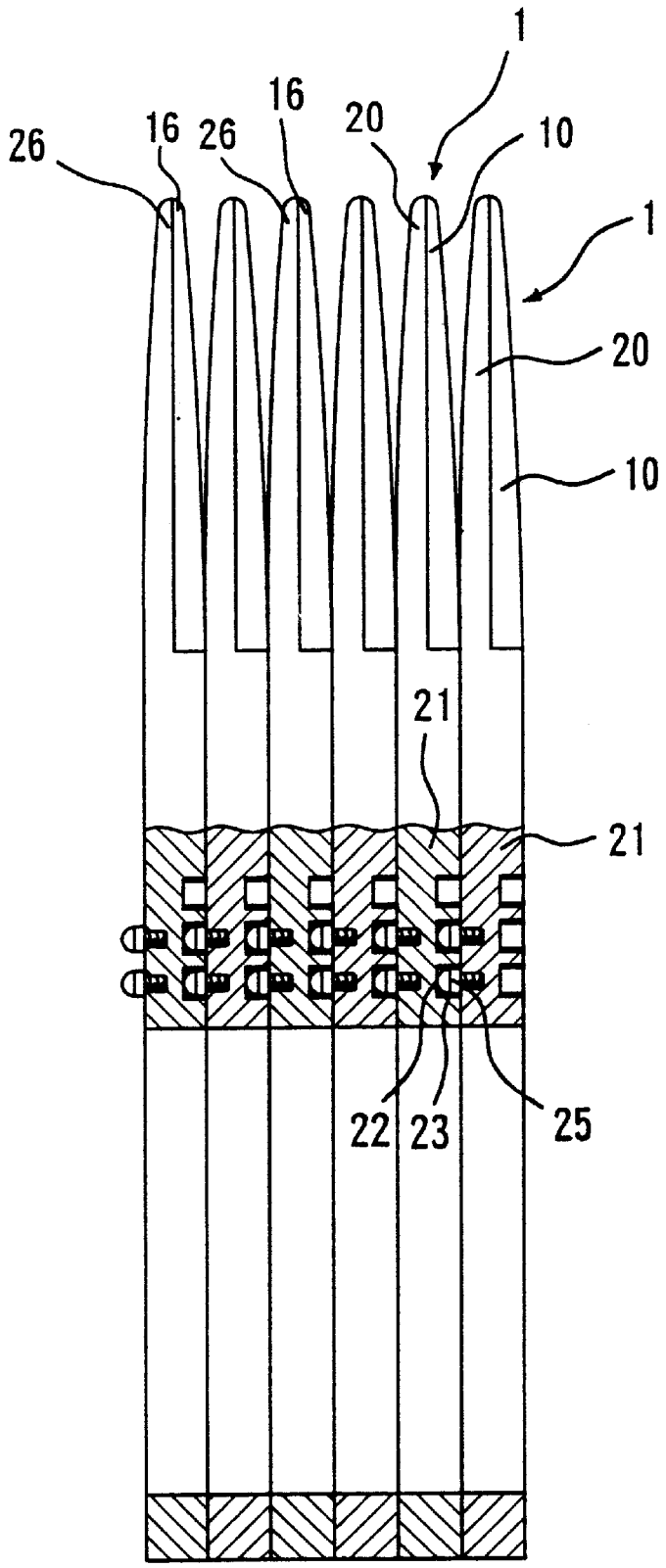
FIG. 5 is a side view, partly sectioned along plane B—B in FIG. 1, of the first embodiment of the hairdressing scissor assembly in accordance with the present invention.
Figure 6:
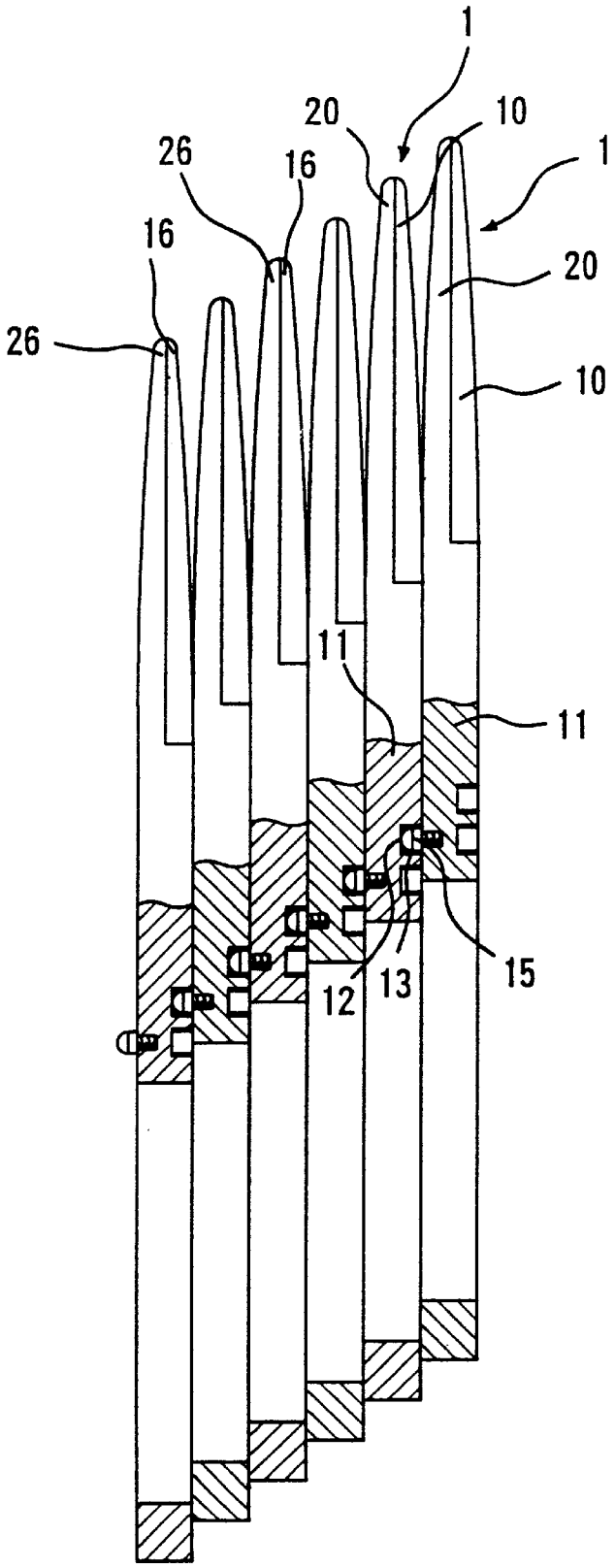
FIG. 6 is a view similar to FIG. 4, wherein the tips of scissors are aligned along an inclined line and located at different levels.

In this embodiment, each positioning hole 14, 24 has an engaging member 15. 25 attached thereto, as shown in FIGS. 1 through 3. The hairdressing scissors 1 in accordance with the present invention can be engaged with one another in a manner illustrated in FIGS. 4 and 5, in which the first end 153 of the engaging member 15 attached to the second side of the first handle 11 of a pair of hairdressing scissors 1 is inserted into the lower one of the two positioning holes 12 of the first side of the first handle 11 of another pair of hairdressing scissors 1, as shown in FIG. 4. In addition, the first ends 253 of the engaging members 25 attached to the second side of the second handle 21 of a pair of hairdressing scissors 1 are inserted into the lower two positioning holes 22 of the first side of the second handle 21 of another pair of hairdressing scissors 1, as shown in FIG. 6. Thus, the tips 16 and 26 of the hairdressing scissors 1 are aligned along a straight line and located at the same level.

Figure 7:
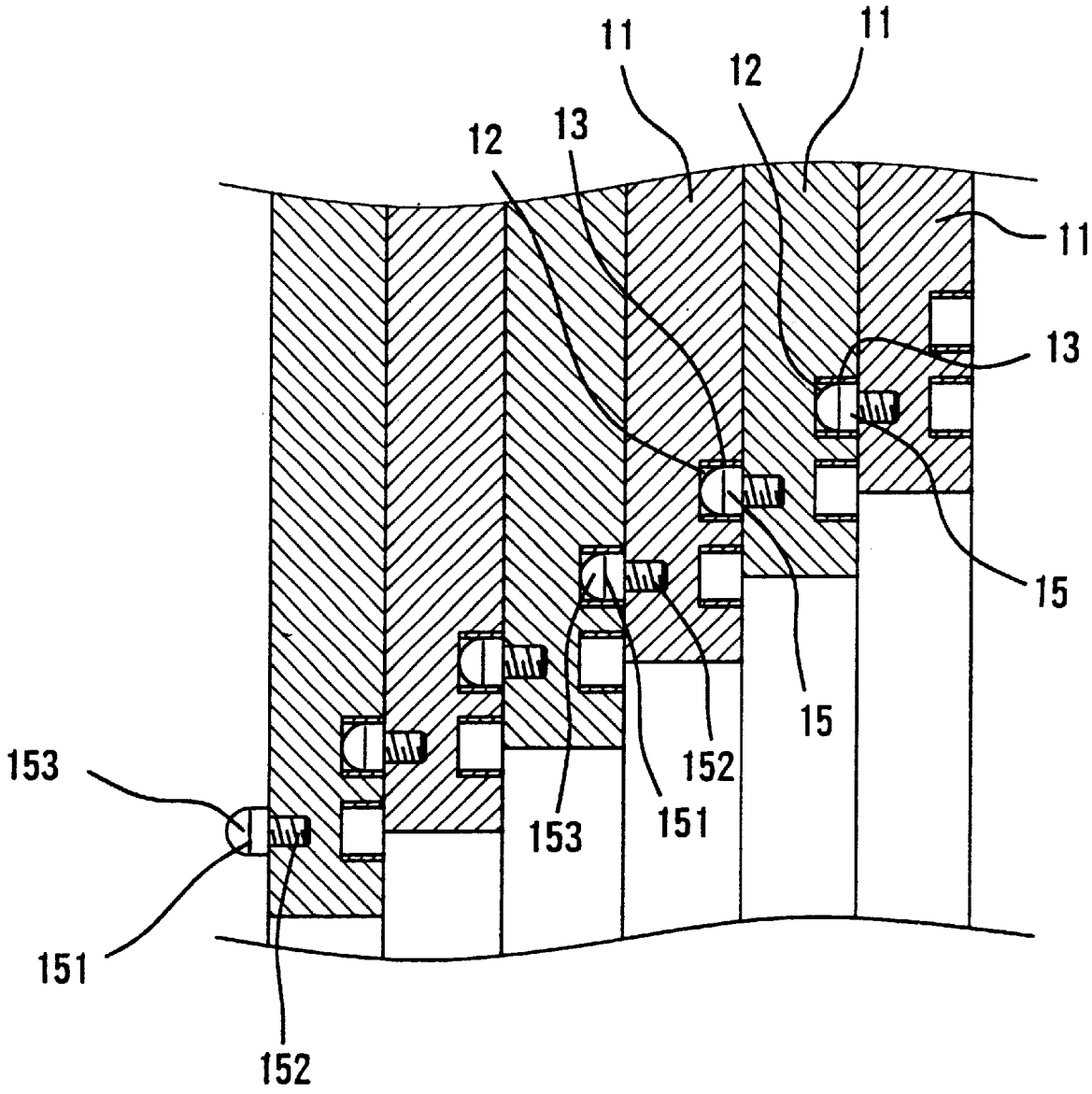
FIG. 7 is an enlarged view of a portion in FIG. 6.
Figure 8:
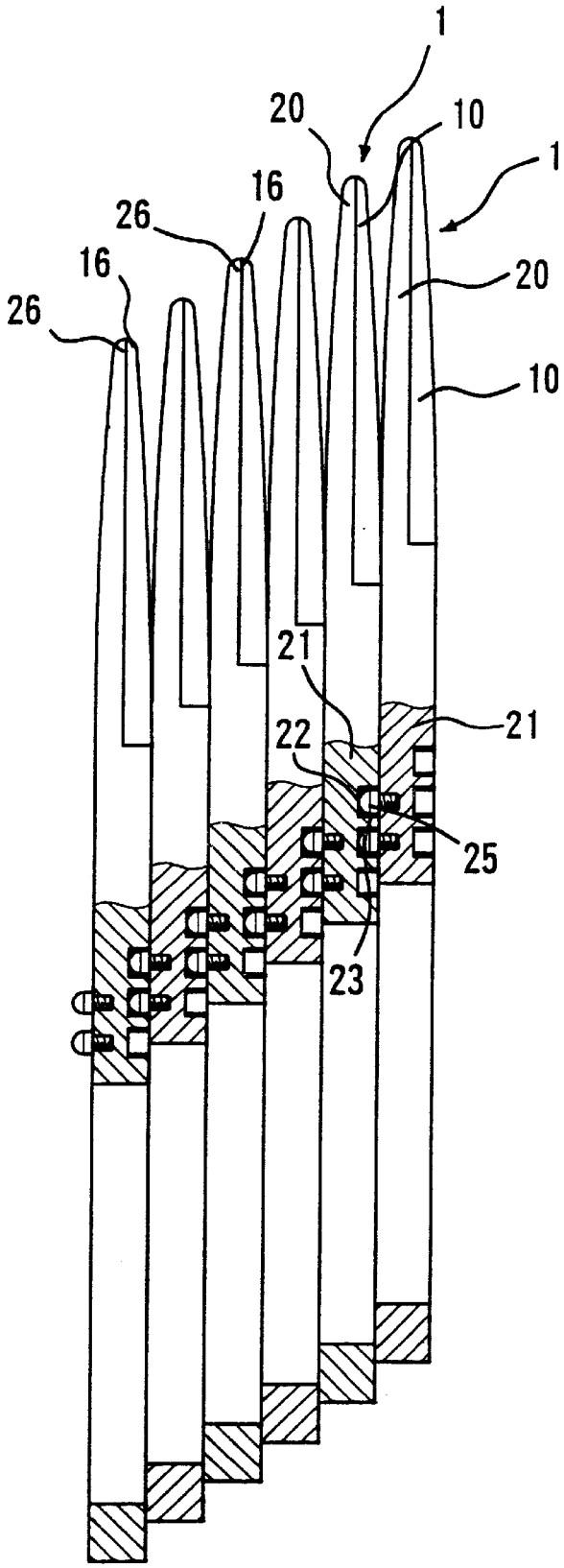
FIG. 8 is a view similar to FIG. 5 wherein the tips of the scissors are aligned along an inclined line and located at different levels.
Figure 9:
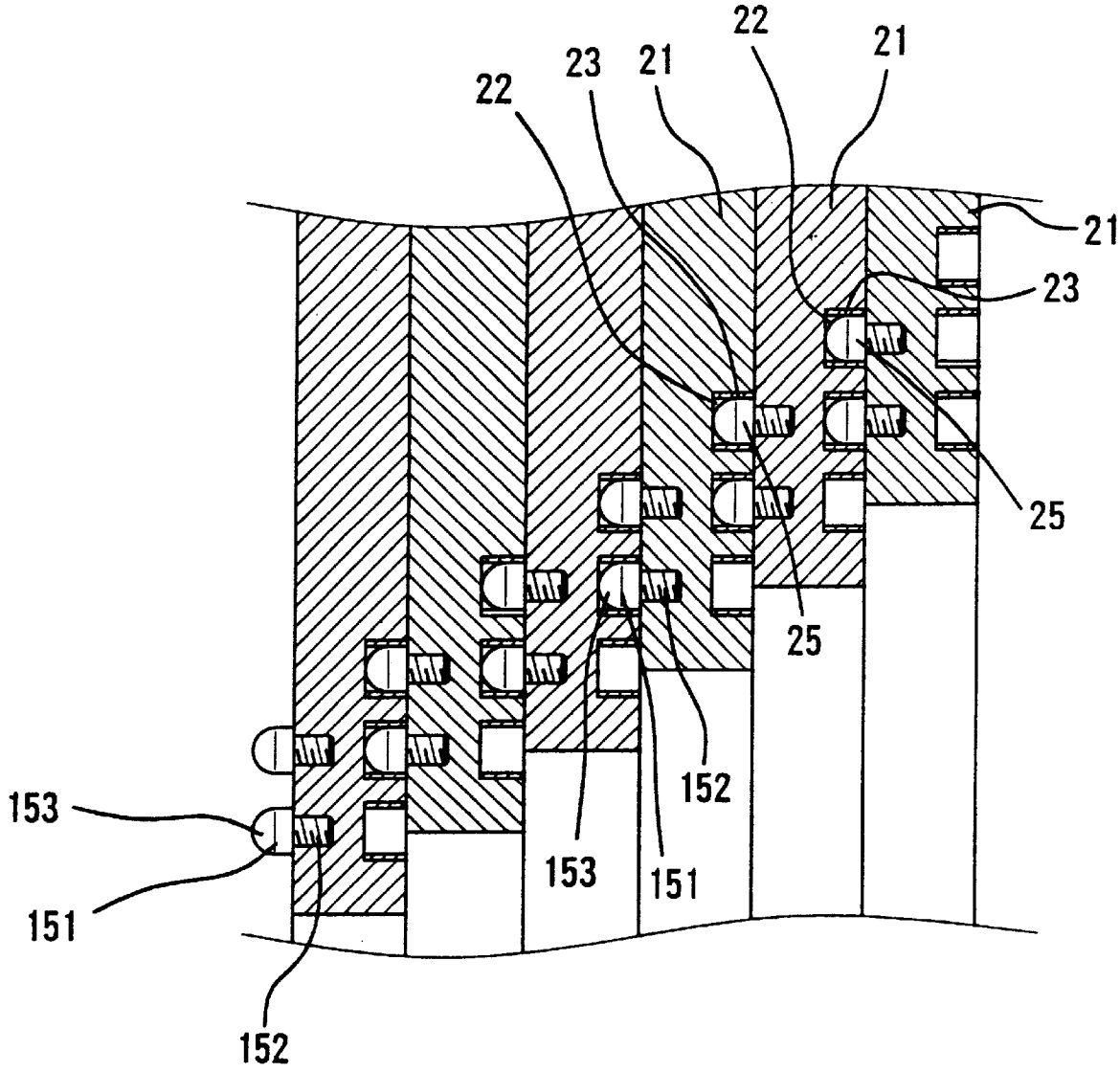
FIG. 9 is an enlarged view of a portion in FIG. 8.

The hairdressing scissors 1 in accordance with the present invention can be engaged with one another in a manner illustrated in FIGS. 6 and 8, in which the first end 153 of the engaging member 15 attached to the second side of the first handle 11 of a pair of hairdressing scissors 1 is inserted into the upper one of the two positioning holes 12 of the first side of the first handle 11 of another pair of hairdressing scissors 1, best shown in FIGS. 6 and 7. In addition, the first ends 253 of the engaging members 25 attached to the second side of the second handle 21 of a pair of hairdressing scissors 1 are inserted into the upper two positioning holes 22 of the first side of the second handle 21 of another pair of hairdressing scissors 1, as shown in FIGS. 8 and 9. Thus, the tips 16 and 26 of the hairdressing scissors 1 are aligned along an inclined line and located at different levels.

The number of the positioning holes 12 in the first side of the first handle 11 is greater than that of the positioning hole(s) 14 in the second side of the first handle 11, and the number of the positioning holes 22 in the first side of the second handle 21 is greater than that of the positioning holes 24 in the second side of the second handle 21. This allows the hairdressing scissors to be arranged either in a manner that the tips 16 and 26 of the hairdressing scissors are aligned along a straight line and located at the same level (FIG. 4) for haircutting purpose or in a manner that the tips 16 and 26 of the hairdressing scissors are aligned along an inclined line (FIG. 6) and located at different levels for hair-layering purpose. When the scissors are arranged in a manner shown in FIG. 6, the user may use the hairdressing scissor assembly to cut and/or thin hair to form a particular, good-looking hairstyle that is popular in hairstyling designs.

Figure 10:
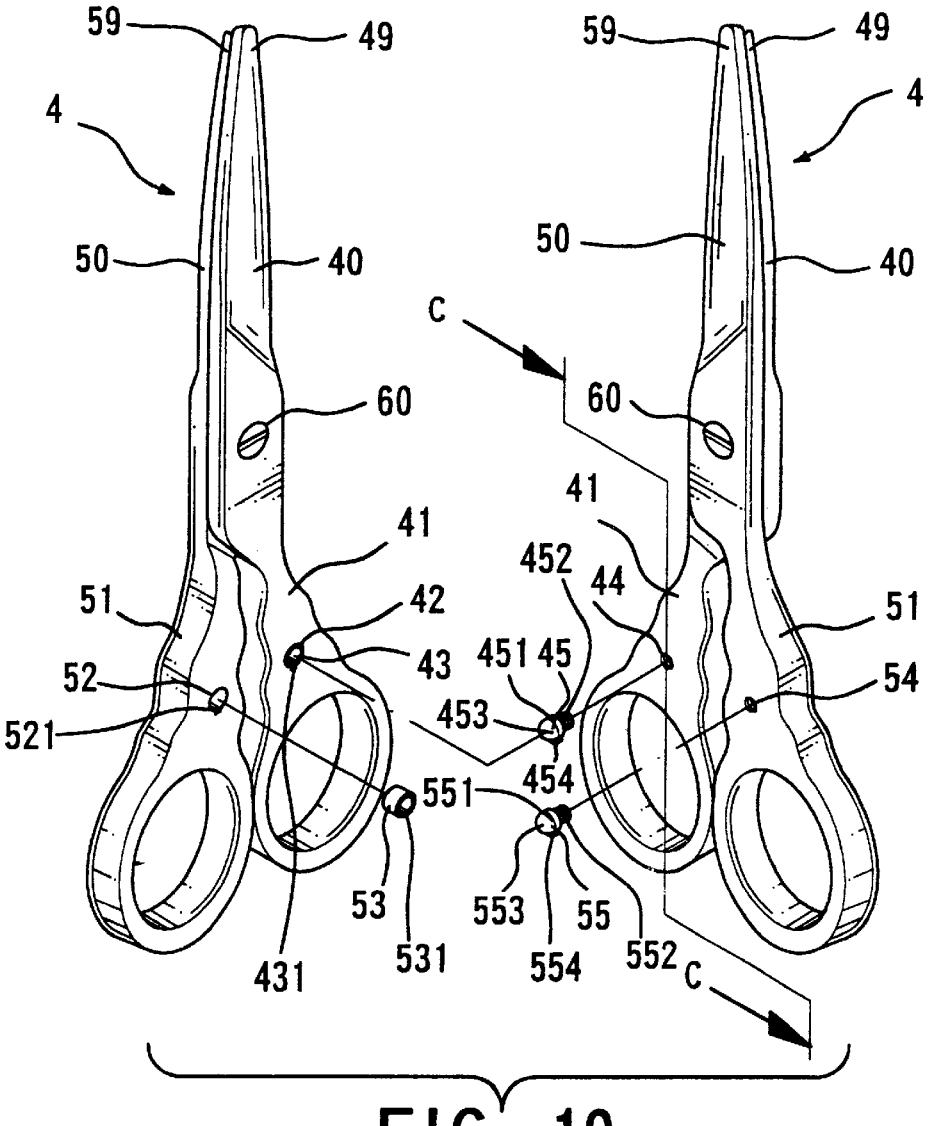
FIG. 10 is an exploded perspective view of a second embodiment of a hairdressing scissor assembly in accordance with the present invention.
Figure 11:
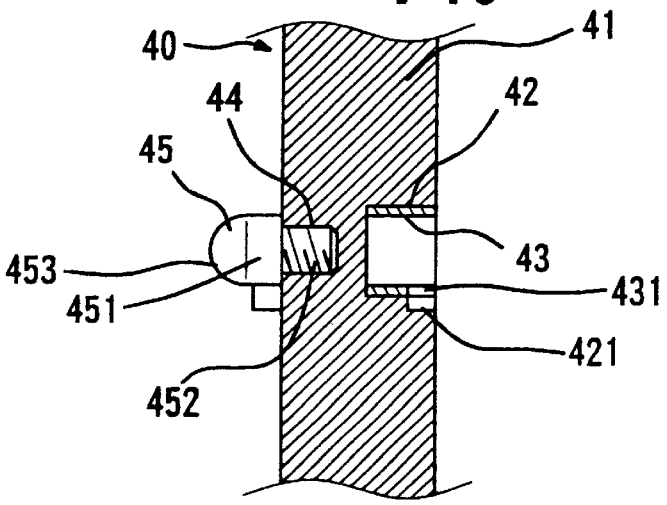
FIG. 11 is a partial sectional view taken along plane C—C in FIG. 10, illustrating a portion of a handle of a hairdressing scissor in FIG. 10.
Figure 12:
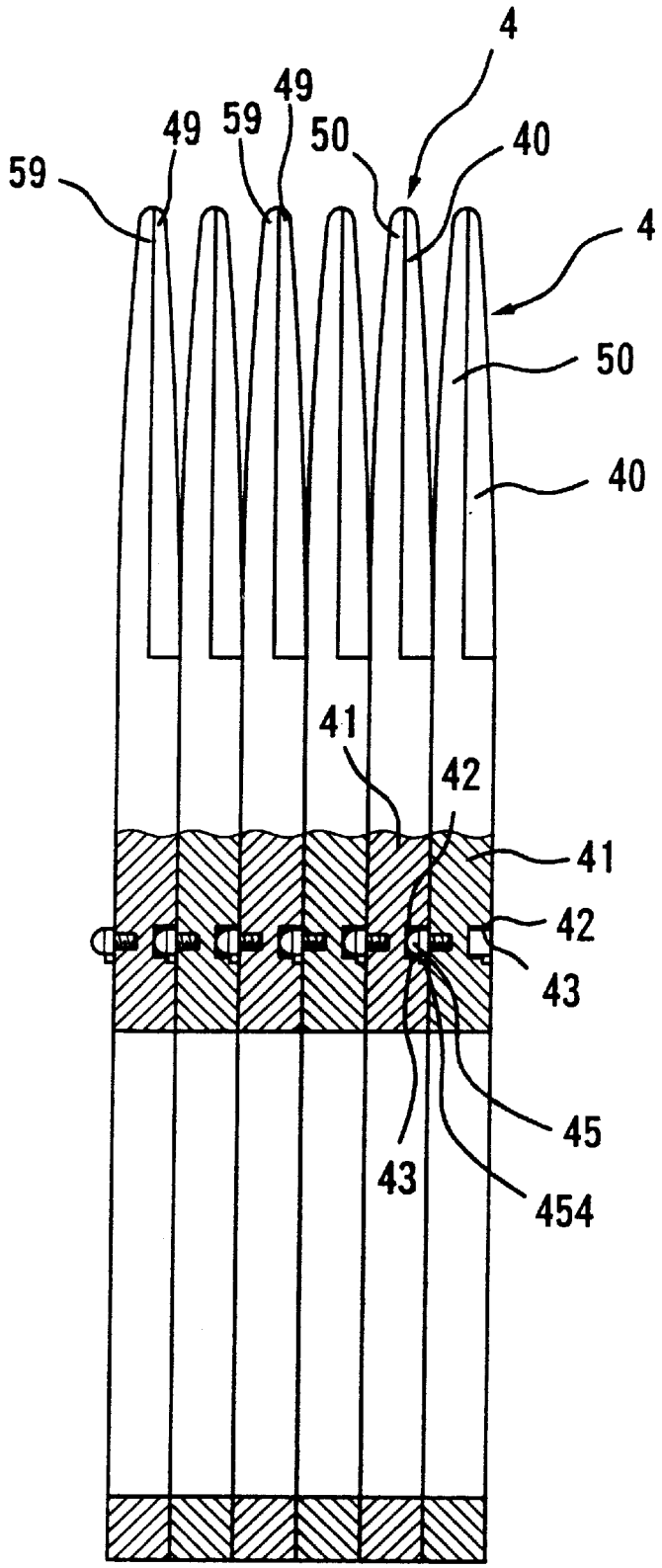
FIG. 12 is a side view, partly sectioned along plane C—C in FIG. 10, of the second embodiment of the hairdressing scissor assembly in accordance with the present invention.

FIGS. 10 through 12 illustrate a simplified embodiment of the present invention wherein the hairdressing scissor comprises plural pairs of scissors 4 each having first and second cutting members that are pivoted together by a pivot 60. The first cutting member comprises a first handle 41 on an end thereof and a first blade 40 on the other end thereof. The second cutting member comprises a second handle 51 on an end thereof and a second blade 50 on the other end thereof. Each blade 40, 50 has a tip 49, 59. The first and second cutting members are pivoted together at intermediate portions thereof.

The first handle 41 comprises a positioning holes 42 defined in a first side thereof and the second handle 51 comprises a positioning hole 52 defined in a first side thereof. The first handle 41 further comprises a positioning hole 44 defined in a second side thereof and the second handle 51 comprises a positioning holes 54 defined in a second side thereof. The positioning holes 44 and 54 may be screw holes.

A sleeve 43, 53, preferably made of rubber or plastic material, is mounted in each positioning hole 12, 22. Two engaging members 15 and 25 are provided and each comprise a first end 451, 551 releasably secured in the associated positioning hole 42, 52 and a second end 452, 552 secured in the associated positioning hole 44, 54. In this embodiment, the second end 452, 552 of each engaging member 45, 55 is threaded for threading engagement with the associated screw hole 44, 54. Nevertheless, the second end 452, 552 of each engaging member 45, 55 can be secured to the second side of the associated handle 41. 51 by force fitting, welding, bonding, or any other suitable means. The first end 451. 551 of each engaging member 45, 55 has a dome 453, 553 for guiding the engaging member 45, 55 into an associated one of the sleeves 43, 53. Further, an inner periphery defining each sleeve 43, 45 has a positioning notch 421, 521, and each sleeve 43, 53 is substantially C-shaped and has a gap 431, 531 aligned with the positioning notch 421, 521. Further, the first end 451, 551 of each engaging member 45, 55 has a protrusion 454, 554 that extends through the respective gap 431, 531 of the respective sleeve 43, 53 into the positioning notch 421, 521, thereby providing an improved positioning effect.

The hairdressing scissors 1 in accordance with the present invention can be engaged one another in a manner illustrated in FIG. 12, in which the tips 49 and 59 of all of the hairdressing scissors 1 are aligned along a straight line and located at the same level.

Figure 13:
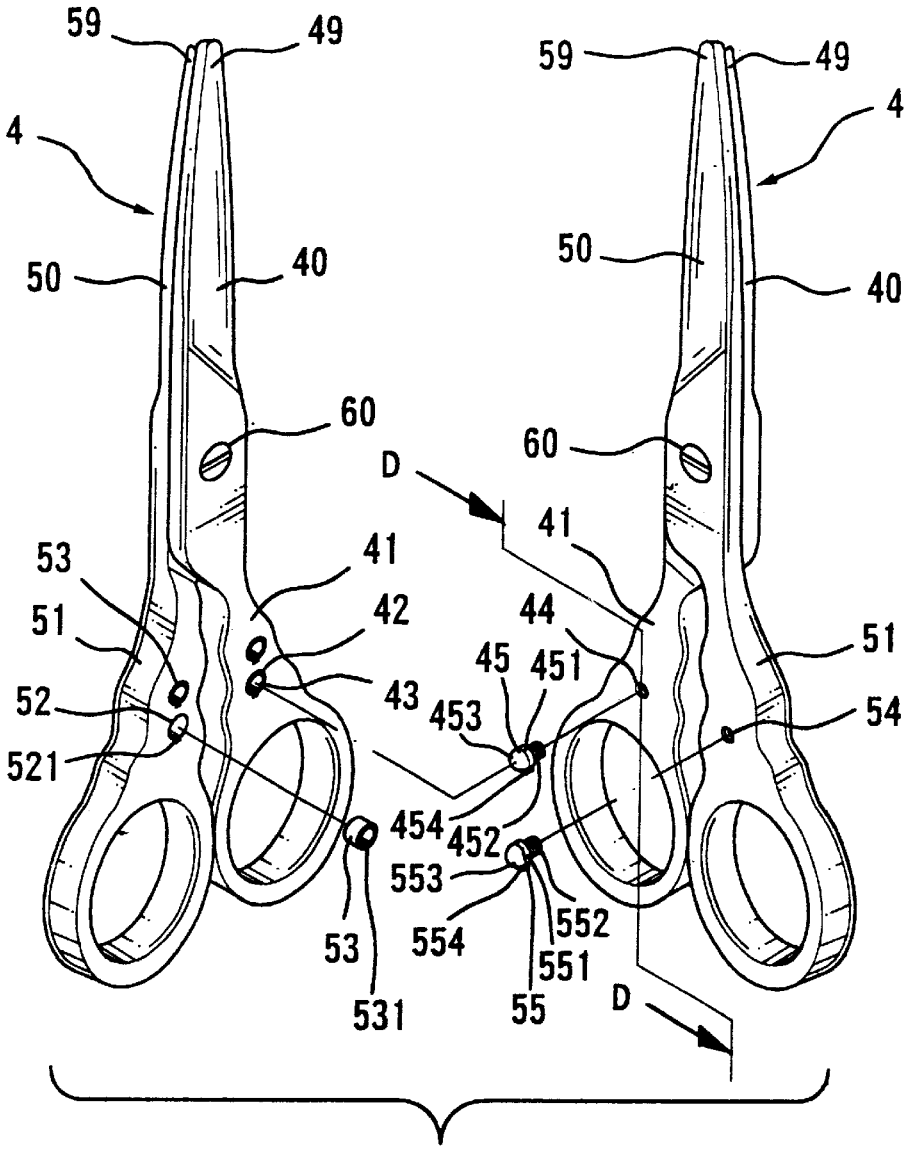
FIG. 13 is an exploded perspective view of a third embodiment of a hairdressing scissor assembly in accordance with the present invention.
Figure 14:
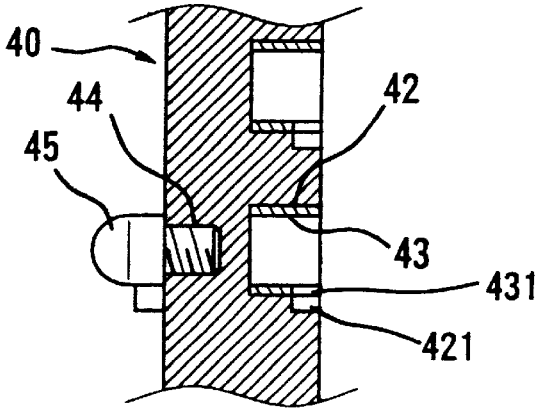
FIG. 14 is a partial sectional view taken along plane D—D in FIG. 13, illustrating a portion of a handle of a hairdressing scissor in FIG. 13.
Figure 15:
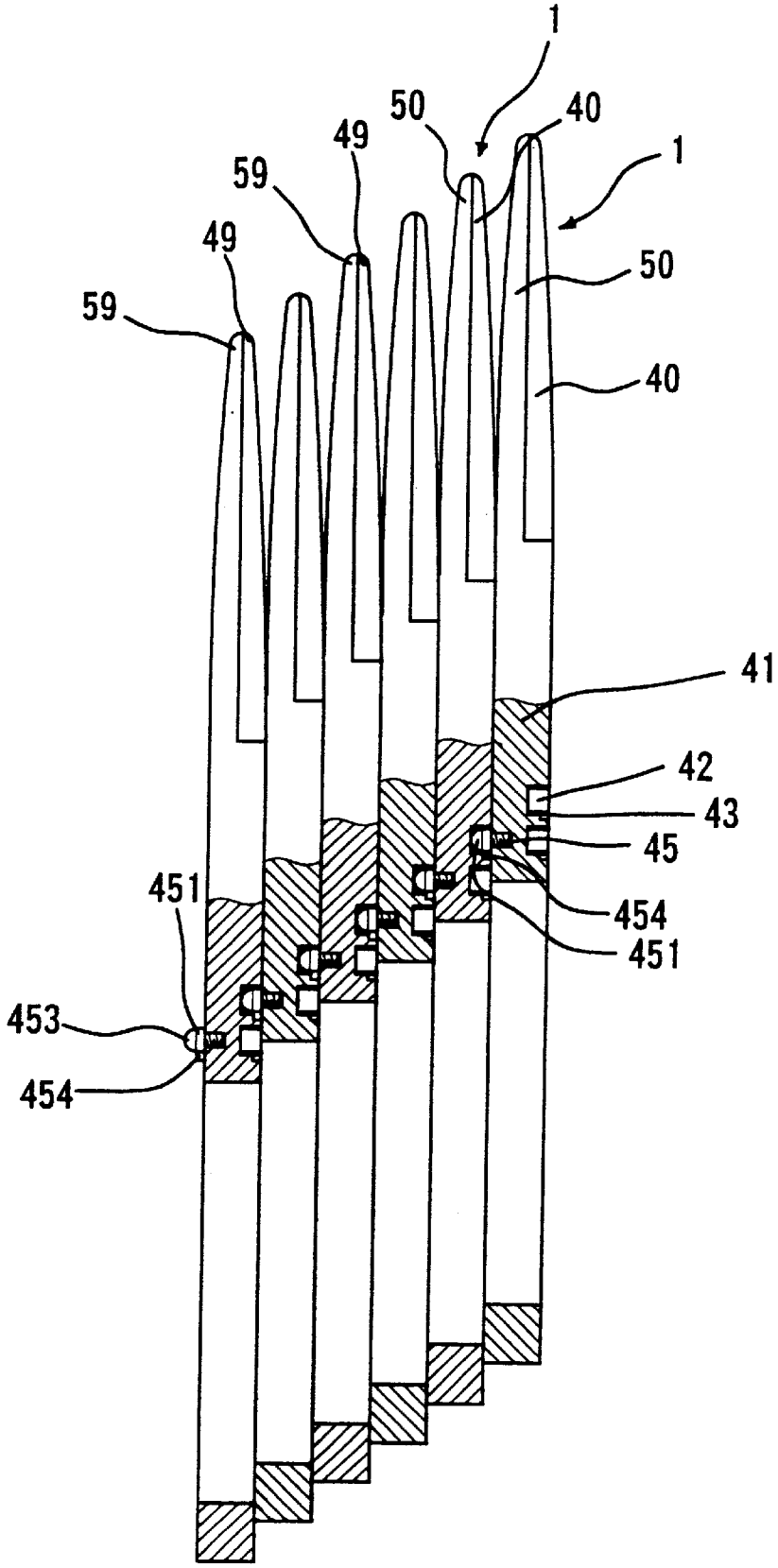
FIG. 15 is a side view, partly sectioned along plane D—D in FIG. 13, of the third embodiment of the hairdressing scissor assembly in accordance with the present invention.

FIGS. 13 through 15 illustrate another embodiment modified from the second embodiment shown in FIGS. 10 through 12. The only difference between these two embodiments is that the first side of each of the first handle 41 and the second handle 51 of each pair of hairdressing scissors 4 of this embodiment has two positioning holes 42, 52 each having a sleeve 43, 53 received therein. This allows the hairdressing scissors 4 to be arranged either in a manner that the tips 49 and 59 of the hairdressing scissors are aligned along a straight line and located at the same level or in a manner that the tips 49 and 59 of the hairdressing scissors are aligned along an inclined line and located at different levels, as shown in FIG. 15.

Figure 16:
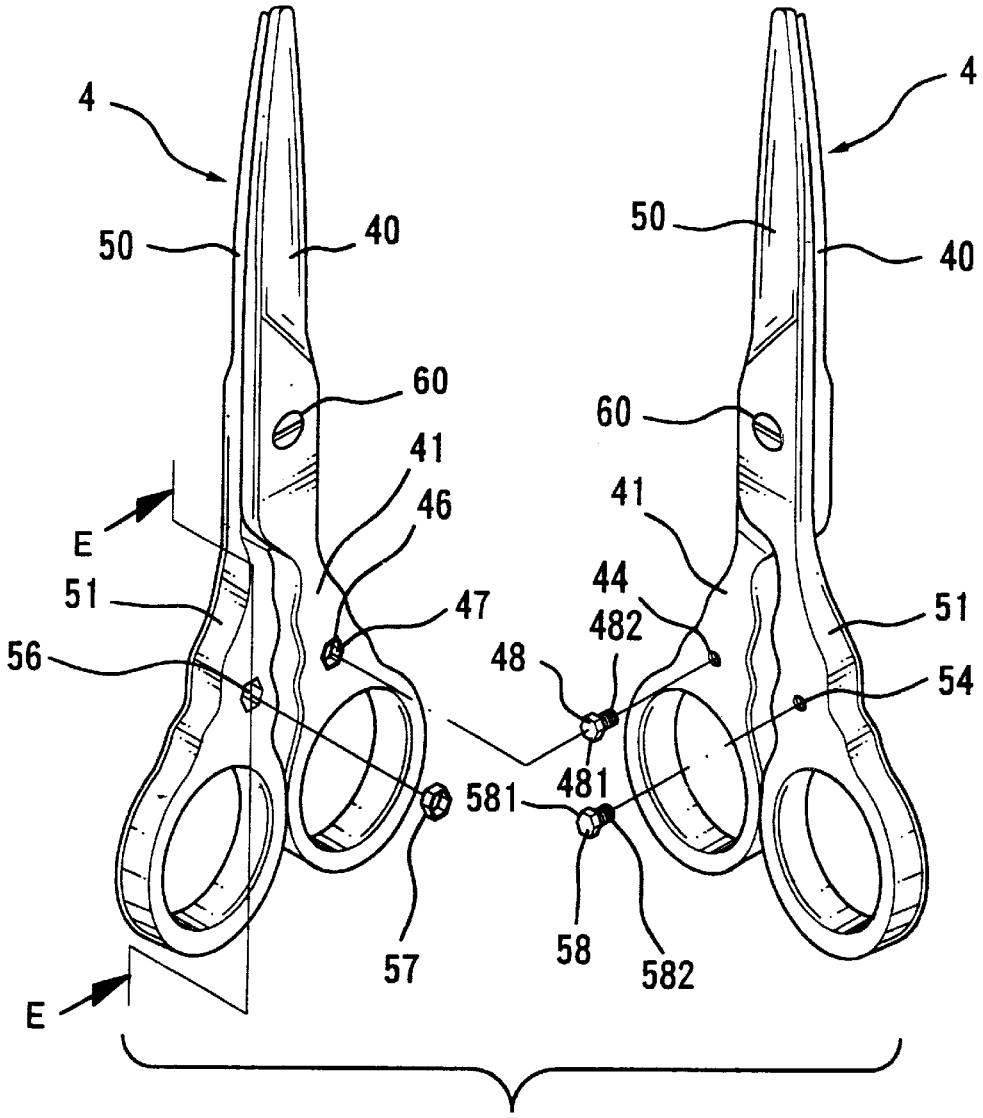
FIG. 16 is an exploded perspective view of a fourth embodiment of a hairdressing scissor assembly in accordance with the present invention.
Figure 17:
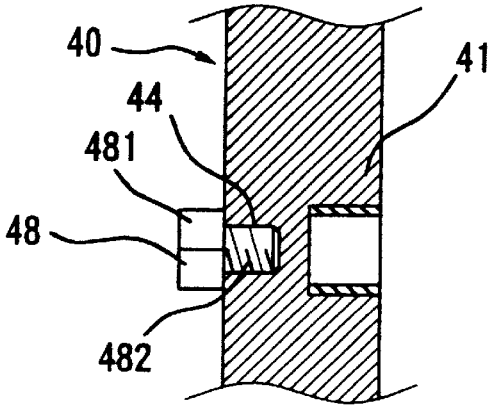
FIG. 17 is a partial sectional view taken along plane E—E in FIG. 16, illustrating a portion of a handle of a hairdressing scissor in FIG. 16.

FIGS. 16 and 17 illustrate a further embodiment modified from the second embodiment shown in FIGS. 10 through 12. The only difference between these two embodiments is that the first side of each of the first handle 41 and the second handle 51 of each pair of hairdressing scissors 4 of this embodiment has a hexagonal positioning hole 46, 56 each having a hexagonal sleeve 47, 57 received therein, in addition, each engaging member 48, 58 is in the form of a bolt having a hexagonal head 481, 581 to be releasably received in an associated hexagonal sleeve 43, 53 and a threaded shank 482, 582 to be threadedly engaged with an associated positioning hole 44, 54. This arrangement provides an improved positioning effect.

Although the invention has been explained in relation to its preferred embodiment, it is to be understood that many other possible modifications and variations can be made without departing from the scope of the invention as hereinafter claimed.

What is claimed is:

1. A pair of hairdressing scissors comprising:

a first cutting member and a second cutting member pivotally connected together, the first cutting member comprising a first handle at a first end thereof and a first blade at a second end thereof, the second cutting member comprising a second handle at a first end thereof and a second blade at a second end thereof, the first handle comprising a first side and a second side, at least one first positioning hole being defined in the first side of the first handle, the second handle comprising a first side and a second side, at least one second positioning hole being defined in the first side of the second handle;

at least one first engaging member secured to the second side of the first handle, said at least one first engaging member comprising an end; and at least one second engaging member secured to the second side of the second handle, said at least one second engaging member comprising an end;

the end of said at least one first engaging member of one said pair of hairdressing scissors being releasably force fitted into said at least one first positioning hole of another said pair of hairdressing scissors;

the end of said at least one second engaging member of one said pair of hairdressing scissors being releasably force fitted into said at least one second positioning hole of another said pair of hairdressing scissors.

2. The pair of hairdressing scissors as claimed in claim 1, wherein the end of said least one first engaging member comprises a dome.

3. The pair of hairdressing scissors as claimed in claim 1, wherein the second side of the first handle comprises a screw hole, another end of said least one first engaging member being threaded for threading engagement with the screw hole.

4. The pair of hairdressing scissors as claimed in claim 1, wherein said at least one first positioning hole comprises a resilient sleeve mounted therein for receiving the end of said at least one first engaging member.

5. The pair of hairdressing scissors as claimed in claim 4, wherein an inner periphery defining said at least one first positioning hole comprises a positioning notch, the resilient sleeve being substantially C-shaped and comprising a gap aligned with the positioning notch, the end of said at least one first positioning member comprising a protrusion extending through the gap of the resilient sleeve into the positioning notch.

6. The pair of hairdressing scissors as claimed in claim 1, wherein said at least one first positioning hole is hexagonal and said at least one first engaging member is a bolt.

7. The pair of hairdressing scissors as claimed in claim 6, wherein said at least one first positioning hole further comprising a hexagonal sleeve mounted therein for receiving a bolt head of the bolt.

8. The pair of hairdressing scissors as claimed in claim 1, wherein the end of said least one second engaging member comprises a dome.

9. The pair of hairdressing scissors as claimed in claim 1, wherein the second side of the second handle comprises a screw hole, another end of said least one second engaging member being threaded for threading engagement with the screw hole.

10. The pair of hairdressing scissors as claimed in claim 1, wherein said at least one second positioning hole comprises a resilient sleeve mounted therein for receiving the end of said at least one second engaging member.

11. The pair of hairdressing scissors as claimed in claim 10, wherein an inner periphery defining said at least one second positioning hole comprises a positioning notch, the resilient sleeve being substantially C-shaped and comprising a gap aligned with the positioning notch, the end of said at least one first positioning comprising a protrusion extending through the gap of the resilient sleeve into the positioning notch.

12. The pair of hairdressing scissors as claimed in claim 1, wherein said at least one second positioning hole is hexagonal and said at least one second engaging member is a bolt.

13. The pair of hairdressing scissors as claimed in claim 12, wherein said at least one second positioning hole further comprising a hexagonal sleeve mounted therein for receiving a bolt head of the bolt.

14. The pair of hairdressing scissors as claimed in claim 1, wherein a number of said at least one first positioning hole is greater than that of said at least one first engaging member.

15. The pair of hairdressing scissors as claimed in claim 1, wherein a number of said at least one second positioning hole is greater than that of said at least one second engaging member.

16. The pair of hairdressing scissors as claimed in claim 15, wherein a number of said at least one second positioning hole is greater than that of said at least one second engaging member.

17. The pair of hairdressing scissors as claimed in claim 4, wherein a number of said at least one first positioning hole is greater than that of said at least one first engaging member.

18. The pair of hairdressing scissors as claimed in claim 17, wherein a number of said at least one second positioning hole is greater than that of said at least one second engaging member.

19. The pair of hairdressing scissors as claimed in claim 5, wherein a number of said at least one first positioning hole is greater than that of said at least one first engaging member.

20. The pair of hairdressing scissors as claimed in claim 19, wherein a number of said at least one second positioning hole is greater than that of said at least one second engaging member.

* * * * *